United States Patent [19]

Richard et al.

[11] Patent Number: 4,944,347

[45] Date of Patent: Jul. 31, 1990

[54] METHOD AND APPARATUS FOR DIRECT HIGH VELOCITY PREPARATION OF COMPLETION/WORKOVER SYSTEMS

[75] Inventors: Bennett M. Richard; Michael H. Johnson, both of Lafayette, La.

[73] Assignee: Baker Hughes Incorporated, Houston, Tex.

[21] Appl. No.: 445,420

[22] Filed: Dec. 4, 1989

[51] Int. Cl.[5] ..... E21B 43/04

[52] U.S. Cl. ..... 166/278; 137/268; 166/51; 166/75.1; 166/90; 166/379; 366/156; 406/57

[58] Field of Search ..... 166/379, 70, 75.1, 90, 166/305.1, 278, 51; 175/206; 366/150, 154, 155, 156, 157; 137/268; 406/57, 55, 56, 58, 61

[56] References Cited

U.S. PATENT DOCUMENTS

| | | | |
|---|---|---|---|
| 2,014,770 | 9/1935 | Layne | 166/51 |
| 2,349,062 | 5/1944 | Uren | 166/278 |
| 2,626,779 | 1/1953 | Armentrout | 166/278 |
| 3,489,394 | 1/1970 | Stogner et al. | 166/305.1 |
| 3,900,547 | 8/1975 | Hunt et al. | 366/157 X |
| 4,068,831 | 1/1978 | Ebeling et al. | 366/156 |
| 4,232,973 | 11/1980 | Ligouzat | 366/157 |
| 4,474,239 | 10/1984 | Colomb et al. | 166/278 |
| 4,574,880 | 3/1986 | Handke | 166/75.1 |
| 4,801,210 | 1/1989 | Giom | 366/156 |

*Primary Examiner*—Hoang C. Dang

*Attorney, Agent, or Firm*—Hubbard, Thurman, Turner & Tucker

[57] ABSTRACT

An apparatus is provided for direct high velocity, consistent, uniform preparation of completion/workover systems for use in subterranean wells. The system has a screw type conveyor extending through a mixing housing which is in direct communication with a pump. Passageways are provided through the housing for the screw type rotatable conveyor and through the mixing chamber housing in axial alignment with openings in the pump such that the diametric area between the interior of the mixing housing and the exterior of the conveyor housing provides sufficient transport velocity for the carrier fluid and the solid particulate matter from the point of mixing in the annulus, through the annulus and to the inlet of the pump.

8 Claims, 2 Drawing Sheets

METHOD AND APPARATUS FOR DIRECT HIGH VELOCITY PREPARATION OF COMPLETION/WORKOVER SYSTEMS

BACKGROUND OF THE INVENTION

1. Field of the Invention:

The invention relates to an apparatus and method for high velocity preparation of completion/workover systems for use in subterranean well operations.

2. Description of the Prior Art:

During some aspects of the completion or workover of a subterranean oil, gas injection or disposal well, particularly in offshore areas, such as the Texas and Louisiana Gulf Coast area, it has been frequently found that the production zones are such that the produced fluid, whether it be oil or gas or mixtures thereof, will carry with it, through the subterranean well conduit and to the top of the well, solid matter, commonly referred to as "sand". Such abrasive solids are undesirable for a number of reasons. For example, erode surface equipment and flow lines and sand in the production fluids can cut seals in well tools, such as safety valves and the like, as well as adversely affect pumping action of well pumps and the like.

In the past, those skilled in the art have attempted to abate such production of sand within the production fluids by "gravel packing" the well. This procedure customarily has entailed the introduction of a larger solid, such as bauxite, sintered bauxite, glass beads, or gravel or similar solids into a pumpable fluid, such as water, brine, polymeric gel, or the like, at the top of the well, through the well and deposited exteriorly around a screen system carried on the production conduit. The solid particulate gravel packing matter is deposited in an annular area that is defined between the exterior of the screen assembly and the interior of the subterranean well bore. Upon a deposition of such gravel packing solids within such annular area, the carrier fluid is pumped through the screen, through the well conduit to the top of the well and may be recycled therethrough by introduction of additional gravel packing solid matter thereto, until the well is satisfactorily gravel packed.

In the past, there have been some problems in the preparation of such gravel packing systems as well as systems in which a solid is to be blended or otherwise prepared for introduction into the well by a carrier fluid for fracturing, cementing and other completion/workover operations. Thus, reference to "completion/workover systems" refers to gravel packing, fracturing, cementing fluids which combine one or more solids in a carrier fluid. Typically, such systems have been prepared by first preparing the carrier fluid in a tank, pit, or the like, adjacent the well and by introduction of the gravel or other solid thereto. A lightening mixer, or the like, may be used for the blending operation. A pump, such as a triplex pump, has been utilized to pump the prepared system including the carrier fluid and the particulate matter, from the tank or pit into the subterranean well.

However, such procedure has been found to have several disadvantages, including the fact that such procedure is time consuming and because the preparation or "blending" operation is, in effect, performed in a tank, pit, or the like, away from the pump, dead spots will occur in flow lines used to transport the prepared system and the pump itself resulting in deposition of the particulate matter thereby hindering the placement of the particulate matter in the subterranean well.

The present invention addresses the problems set forth above and provides a method and apparatus which eliminate the dead spots in the pump and flow lines provides a continuous agitation of the particulate matter within the carrier fluid during the actual mixing or preparation operation. Additionally, by use of the present invention, the agitation which heretofore has occurred some distance from the triplex or other pump device is now placed at the pump itself and within a mixing chamber diametric area. The elimination of the dead spots additionally provides a uniform distribution of the particulate matter in the carrier fluid.

DESCRIPTION OF THE PREFERRED EMBODIMENTS

Figure 1:
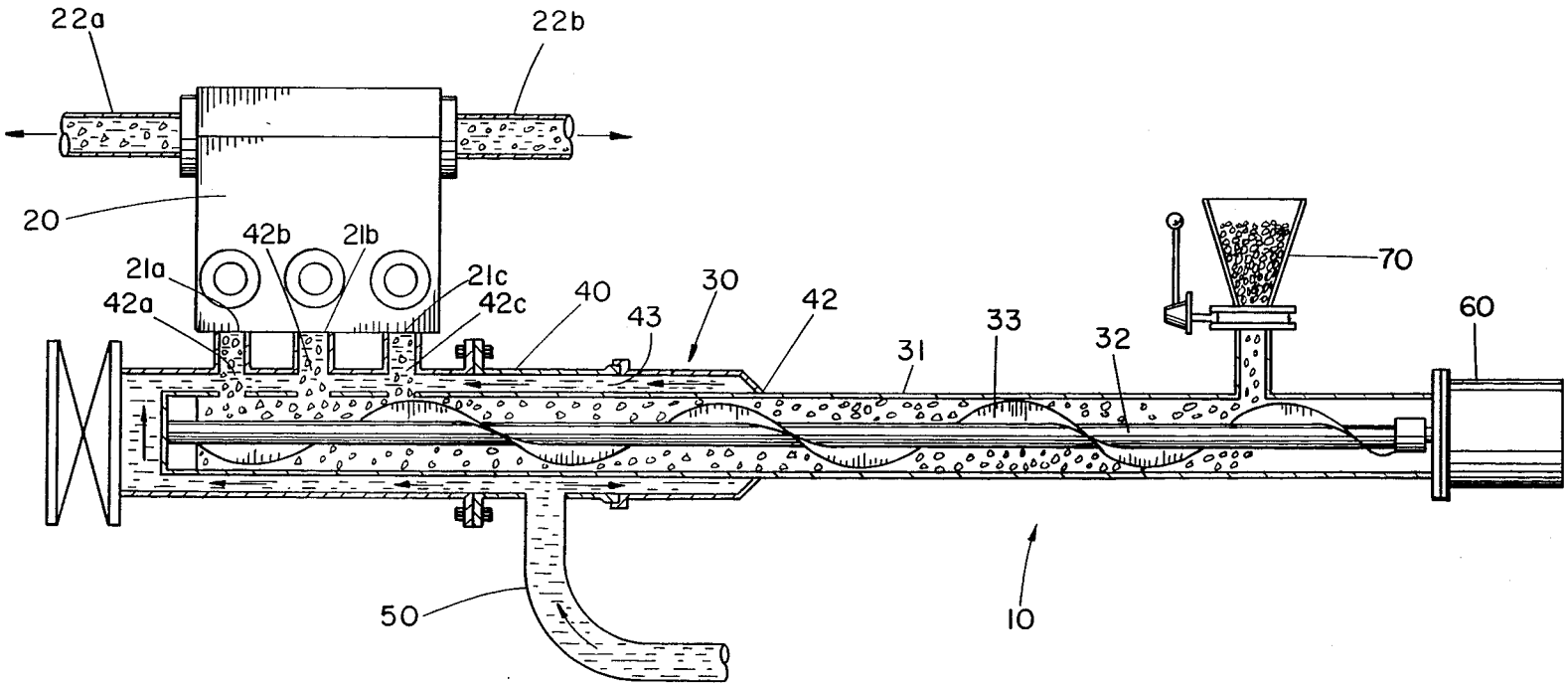
FIG. 1 is a schematic partial sectional illustration of the apparatus of the present invention.

With reference to FIG. 1, there is shown an apparatus 10, which includes a fluid pump means 20, a conveyor system 30, a cylindrical mixing housing 40 means for transmission and receipt of a carrier fluid 50, and, finally, a means 60 for activation of the conveyor system 30.

The fluid pump means 20 may be any pump system heretofore utilized by the prior art, which is capable of high volume pressure pumping of completion/workover systems into and through subterranean well bores. Such pumps may include triplex pumps.

As shown in FIG. 1, the fluid pump means 20 has at its uppermost portion high pressure slurry outlets **22*a* and 22*b*** for direct fluid communication with a conduit extending into the subterranean well.

The fluid pump means 20 also has at its lowermost end fluid inlet means, **21*a*, 21*b* and 21*c* which are axially aligned with companion second fluid flow passages 42*a*, 42*b* and 42*c*, respectively, which are bored through the cylindrical mixing housing 40**.

The fluid pump means 20 is directly secured to a conveyor system 30 which comprises an outer cylindrical conveyor housing 31 extending to just below the fluid pump means 20 at one end thereof and to an activation means 60 for a screw conveyor or elongated rotatable conveyor 32 or the like which is disposed within the cylindrical conveyor housing 31.

The rotatable conveyor 32 may be solid or tubular, but in any case will have a circumferentially extending transporting blade 33 configuration implaced around its exterior such that as the conveyor 32 is rotatably activated by the means 60, particulate matter, such as gravel or the like, which is introduced through a hopper 70 or other means for introduction of such particulate matter into the conveyor system 30 will deposit such particulate matter around the exterior of the conveyor 32 and the transporting blade 33 will move it within the housing 31 and dispose it through the cylindrical mixing housing 40.

The housing 40 is secured to the fluid pump means 20 at its lowermost end and has an inlet 42 for securing receipt of the cylindrical conveyor housing 31.

Means for transmission and receipt of the carrier fluid 50 are provided within the cylindrical mixing housing 40, but such means 50, may be provided along any portion of the cylindrical mixing housing 40, or the cylindrical conveyor housing 31. However, preferably, such carrier fluid is introduced through the means 50 directly into the cylindrical mixing housing 40 because of the annular area or mixing annulus 43 provided therein which has a diametric area between the interior of the mixing housing 40 and the exterior of the cylindrical housing 31 sufficient to provide elimination of dead spots within the fluid pump means 20 and to provide sufficient high velocity agitation of the particulate matter and the carrier fluid for direct mixing purposes. Preferably, such diametric area will be no more than about 20% of the internal diameter of the cylindrical mixing housing 40.

The means for activation 60 of the elongated rotatable conveyor 32 may be any type of belt drive, hydraulic drive, or the like, customarily used in such operations with respect to screw-type or similar conveyor systems.

OPERATION

Figure 2:
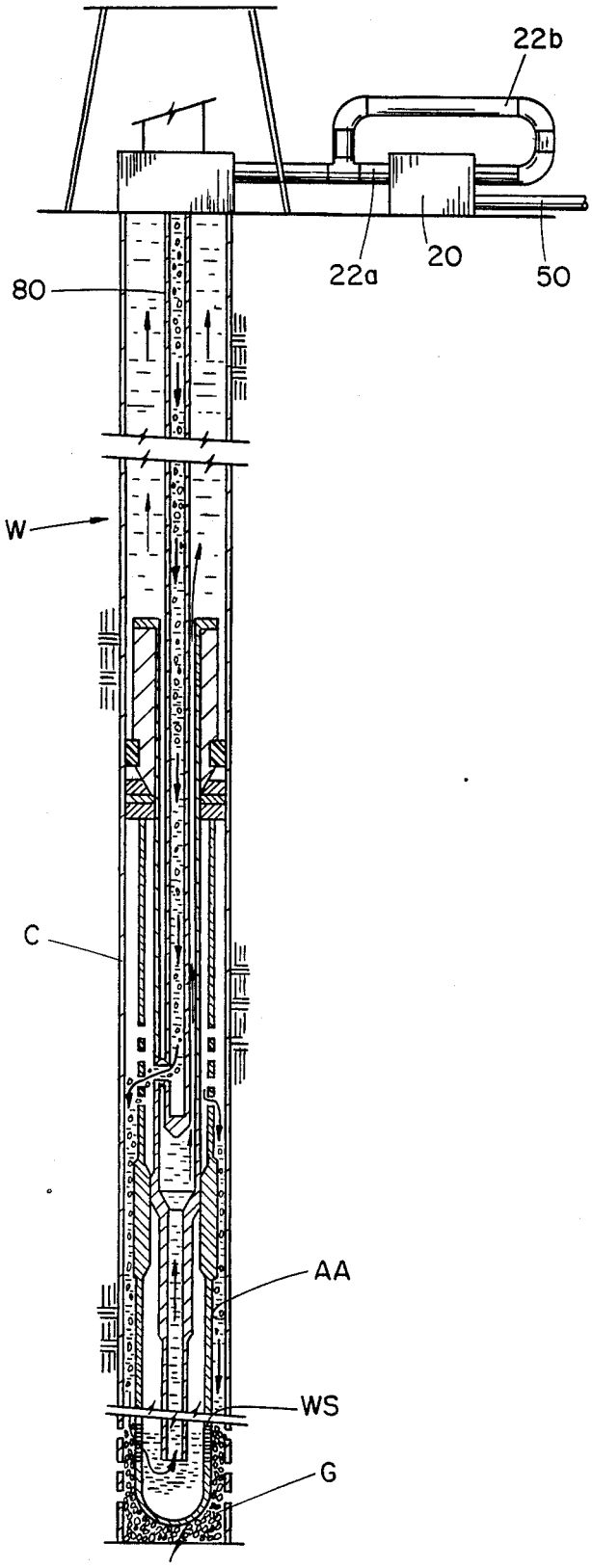
FIG. 2 is a sectionalized illustration of the apparatus and the flow path of gravel in carrier fluid in the well.

When it is desired to, for example, gravel pack a subterranean well or perform the desired operation using a completion/workover system, the production or workover tubing in the well is in fluid communication with the slurry outlets 22*a* , 22*b*, of the fluid pump means 20, and the apparatus 10 will be provided in the form as shown in FIG. 1. The particulate matter, which is pre-selected, will be introduced into the hopper 70 and the hydraulic drive 60 will be activated to rotate the conveyor 32. The carrier fluid will be introduced through the line or inlet 50 into the mixing annulus 43 as the fluid pump means 20 is activated. As the gravel is introduced into the conveyor housing 31 the blade 33 on the rotatable conveyor 32 will carry such gravel into the mixing annulus 43 for mixing with the carrier fluid 50. Such fluid and the particulate matter will be blended in high velocity in the mixing annulus 43 diametric area and carried from the ports 42*a*, 42*b* and 42*c* to the companion fluid inlet means 21*a*, 21*b* and 21*c* of the fluid pump means 20, thence through the pump and through outlets 22*a* , 22*b*, and into the fluid transmission conduit 80 (FIG. 2) in the subterranean well W for deposition of the gravel G exterior of a well screen WS and deposited in an annular area AA between the screen WS and the casing C of the subterranean well W. Thereafter, the carrier fluid is circulated through the well W to the low pressure fluid inlet 50 for mixing additional quantities of the particulate matter with carrier fluid for introduction into the well.

It will be appreciated from the foregoing that when the apparatus and method of the present invention are utilized, the pump will operate more efficiently because of the uniformity of the blend. Because there are no slugs of sand, the agitation in the annular area 43 is sufficient to transport the solid particulate matter. Additionally, because there are no slugs of solids, valves operate more efficiently.

The present invention provides a method and apparatus for preparation of a completion/workover system with high uniformity by incorproation an annular mixing area that provides sufficiently high velocity to transport the solids as they are introduced into the fluid stream, and, in turn, through the pump. Since the solid is introduced into the fluid stream at a point in close proximity to the fluid inlet or suction point of the pump, there isn ot time for dead spots to develop and permit the solid to drop out of the carrier fluid.

It will also be appreciated from the foregoing that the sizing of the annular area 43 is for the purpose of creating sufficient fluid velocity to pick up and transport the solid particulate matter and carry it into the pump without excessively restricting the pump suction area.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for direct high velocity preparation of completion/workover systems incorporating a solid particulate matter into a carrier fluid for use in subterranean wells, comprising:

(a) fluid pump means having inlet and outlet members;

(b) a conveyor system having: a cylindrical conveyor housing; an elongated rotatable conveyor disposed therethrough; and a circumferentially extending transporting blade axially defined around the outer length of said conveyor;

(c) a cylindrical mixing housing secured relative to said pump means;

(d) an inlet through said cylindrical mixing housing for receipt of said conveyor housing;

(e) first fluid flow passages defined through said cylindrical mixing housing and in fluid communication with the inlet members of the pump means;

(f) second fluid flow passages defined through said conveyor housing and in relative axial alignment with said first fluid flow passages;

(g) a mixing annulus within the mixing housing and having a diametric area between the interior of said mixing housing and the exterior of said conveyor housing sufficient to provide a transport velocity for the carrier fluid and the solid particulate matter from the point of mixing thereof in the annulus and through said annulus to said inlet member of said pump means;

(h) means for transmission and receipt of a carrier fluid through the mixing housing and into the mixing annulus;

(i) means for activation of said rotatable conveyor; and (j) means for introduction of particulate matter into said cylindrical conveyor housing upstream of said means for transmission of said carrier fluid.

2. The apparatus of claim 1 wherein said pump means comprises a triplex pump.

3. The apparatus of claim 1 wherein the means for activation of said rotatable conveyor comprises a hydraulic drive operably and relatively secured to one end of said elongated rotatable conveyor.

4. The apparatus of claim 1 wherein said carrier fluid is a member selected from the class consisting of water, brine, polymeric gels, liquid hydrocarbons, and mixtures thereof.

5. The apparatus of claim 1 wherein the diametric area between the interior of the mixing housing and the exterior of the conveyor housing is no more than about 20% of the internal diameter of said cylindrical mixing housing.

6. Method of direct high velocity preparation of completion/workover systems incorporating a solid particulate matter into a carrier fluid for us in subterranean wells, comprising:

(1) providing at the subterranean well site a tubular conduit communicable at one end with the subterranean well and communicating at the other end with a blending apparatus, said blending apparatus comprising:

(a) fluid pump means having inlet and outlet members;

(b) a conveyor system having: a cylindrical conveyor housing; an elongated rotatable conveyor disposed therethrough; and a circumferentially extending transporting blade axially defined around the outer length of said conveyor;

(c) a cylindrical mixing housing secured relative to said pump means;

(d) an inlet through said cylindrical mixing housing for receipt of said conveyor housing;

(e) first fluid flow passages defined through said cylindrical mixing housing and in fluid communication with the inlet members of the pump means;

(f) second fluid flow passages defined through said conveyor housing and in relative axial alignment with said first fluid flow passages;

(g) a mixing annulus within the mixing housing and having a diametric area between the interior of said mixing housing and the exterior of said conveyor housing sufficient to provide a transport velocity for the carrier fluid and the solid particulate matter from the point of mixing thereof in the annulus and through said annulus to said inlet member of said pump means;

(h) means for transmission and receipt of a carrier fluid through the mixing housing and into the mixing annulus;

(i) means for activation of said rotatable conveyor; and (j) means for introduction of particulate matter into said cylindrical conveyor housing upstream of said means for transmission of said carrier fluid;

(2) introducing particulate matter through said means for introduction of particulate matter into the cylindrical conveyor housing;

(3) simultaneously while performing Step (2), activating the rotatable conveyor to transport the particulate matter introduced through said means for introduction of the particulate matter through the interior of the cylindrical conveyor housing and through the cylindrical mixing housing;

(4) introducing a carrier fluid for said particulate matter through the means for transmission and receipt of the carrier fluid and through the mixing housing and into the mixing annulus; and (5) simultaneously with Step 4, activating the fluid pump means to transmit the carrier fluid with the particulate matter therein from the cylindrical mixing housing into the fluid pump inlet and to the conduit in communication with a subterranean well, whereby the activation of the elongated rotatably conveyor provides transport velocity for the carrier fluid and the solid particulate matter within the diametric area between the interior of the mixing housing and the exterior of the conveyor housing.

7. Method of completing a subterranean well, wherein a solid particulate matter is introduced in the well in a carrier fluid, comprising the steps of:

(1) providing at the subterranean well site a tubular conduit communicable at one end with the subterranean well and communicating at the other end with a blending apparatus, said blending apparatus comprising:

(a) fluid pump means having inlet and outlet members;

(b) a conveyor system having: a cylindrical conveyor housing; an elongated rotatable conveyor disposed therethrough; and a circumferentially extending transporting blade axially defined around the outer length of said conveyor;

(c) a cylindrical mixing housing secured relative to said pump means;

(d) an inlet through said cylindrical mixing housing for receipt of said conveyor housing;

(e) first fluid flow passages defined through said cylindrical mixing housing and in fluid communication with the inlet members of the pump means;

(f) second fluid flow passages defined through said conveyor housing and in relative axial alignment with said first fluid flow passages;

(g) a mixing annulus within the mixing housing and having a diametric area between the interior of said mixing housing and the exterior of said conveyor housing sufficient to provide a transport velocity for the carrier fluid and the solid particulate matter from the point of mixing thereof in the annulus and through said annulus to said inlet member of said pump means;

(h) means for transmission and receipt of a carrier fluid through the mixing housing and into the mixing annulus;

(i) means for activation of said rotatable conveyor; and (j) means for introduction of particulate matter into said cylindrical conveyor housing upstream of said means for transmission of said carrier fluid;

(2) introducing particulate matter through said means for introduction of particulate matter into the cylindrical conveyor housing;

(3) simultaneously while performing Step (2), activating the rotatable conveyor to transport the particulate matter introduced through said means for introduction of the particulate matter through the interior of the cylindrical conveyor housing and through the cylindrical mixing housing;

(4) introducing a carrier fluid for said particulate matter through the means for transmission and receipt of the carrier fluid and through the mixing housing and into the mixing annulus;

(5) simultaneously with Step 4, activating the fluid pump means to transmit the carrier fluid with the particulate matter therein from the cylindrical mixing housing into the fluid pump inlet and to the conduit in communication with a subterranean well, whereby the activation of the elongated rotatably conveyor provides transport velocity for the carrier fluid and the solid particulate matter within the diametric area between the interior of the mixing housing and the exterior of the conveyor housing; and (6) transmitting said particulate matter in said carrier fluid through the conduit and the subterranean well, and disposing said particulate matter within said subterranean well, and circulating said carrier fluid out of the interior of said subterranean well to the top of said subterranean well and into said apparatus.

8. Method of completing a subterranean well, wherein a solid particulate matter is introduced in the well in a carrier fluid, comprising the steps of:

(1) providing at the subterranean well site a tubular conduit communicable at one end with the subterranean well and communicating at the other end with a blending apparatus, said blending apparatus comprising:

(a) fluid pump means having inlet and outlet members;

(b) a conveyor system having: a cylindrical conveyor housing; an elongated rotatable conveyor disposed therethrough; and a circumferentially extending transporting blade axially defined around the outer length of said conveyor;

(c) a cylindrical mixing housing secured relative to said pump means;

(d) an inlet through said cylindrical mixing housing for receipt of said conveyor housing;

(e) first fluid flow passages defined through said cylindrical mixing housing and in fluid communication with the inlet members of the pump means;

(f) second fluid flow passages defined through said conveyor housing and in relative axial alignment with said first fluid flow passages;

(g) a mixing annulus within the mixing housing and having a diametric area between the interior of said mixing housing and the exterior of said conveyor housing sufficient to provide a transport velocity for the carrier fluid and the solid particulate matter from the point of mixing thereof in the annulus and through said annulus to said inlet member of said pump means;

(h) means for transmission and receipt of a carrier fluid through the mixing housing and into the mixing annulus;

(i) means for activation of said rotatable conveyor; and (j) means for introduction of particulate matter into said cylindrical conveyor housing upstream of said means for transmission of said carrier fluid;

(2) introducing particulate matter through said means for introduction of particulate matter into the cylindrical conveyor housing;

(3) simultaneously while performing Step (2), activating the rotatable conveyor to transport the particulate matter introduced through said means for introduction of the particulate matter through the interior of the cylindrical conveyor housing and through the cylindrical mixing housing;

(4) introducing a carrier fluid for said particulate matter through the means for transmission and receipt of the carrier fluid and through the mixing housing and into the mixing annulus;

(5) simultaneously with Step 4, activating the fluid pump means to transmit the carrier fluid with the particulate matter therein from the cylindrical mixing housing into the fluid pump inlet and to the conduit in communication with a subterranean well, whereby the activation of the elongated rotatably conveyor provides transport velocity for the carrier fluid and the solid particulate matter within the diametric area between the interior of the mixing housing and the exterior of the conveyor housing; and (6) transmitting said particulate matter in said carrier fluid through the conduit and the subterranean well, and disposing said particulate matter within said subterranean well.

* * * * *